US005215149A

United States Patent [19]

Lu

[11] Patent Number: 5,215,149

[45] Date of Patent: Jun. 1, 1993

[54] SINGLE HORIZONTAL WELL CONDUCTION ASSISTED STEAM DRIVE PROCESS FOR REMOVING VISCOUS HYDROCARBONACEOUS FLUIDS

[75] Inventor: Hong S. Lu, Carrollton, Tex.

[73] Assignee: Mobil Oil Corporation, Fairfax, Va.

[21] Appl. No.: 808,788

[22] Filed: Dec. 16, 1991

[51] Int. Cl.[5] ..... E21B 43/24

[52] U.S. Cl. ..... 166/303; 166/50; 166/57; 166/297

[58] Field of Search ..... 166/50, 57, 263, 297, 166/303, 387; 299/2

[56] References Cited

U.S. PATENT DOCUMENTS

| | | | |
|---|---|---|---|
| 1,634,236 | 6/1927 | Ranney | 299/2 |
| 1,816,260 | 7/1931 | Lee | 166/306 X |
| 2,365,591 | 12/1944 | Ranney | 166/272 |
| 3,024,013 | 3/1962 | Rogers et al. . | |
| 3,338,306 | 8/1967 | Cook | 166/302 |
| 3,386,508 | 6/1968 | Bielstein et al. | 166/303 X |
| 3,547,193 | 12/1970 | Gill | 166/248 |
| 3,960,213 | 6/1976 | Striegler et al. | 166/272 |
| 3,986,557 | 10/1976 | Striegler et al. | 166/272 |
| 4,085,803 | 4/1978 | Butler | 166/50 X |
| 4,116,275 | 9/1978 | Butler et al. | 166/303 |
| 4,153,118 | 5/1979 | Hart | 175/4.51 |
| 4,362,213 | 12/1982 | Tabor | 166/303 X |
| 4,379,592 | 4/1983 | Vakhnin et al. | 299/2 |
| 4,460,044 | 7/1984 | Porter | 166/263 X |
| 4,508,172 | 4/1985 | Mims et al. | 166/50 X |
| 4,640,359 | 2/1987 | Livesey et al. | 166/303 X |
| 4,706,751 | 11/1987 | Gondouin | 166/263 X |
| 5,020,901 | 5/1977 | Pisio et al. | 166/57 X |

*Primary Examiner*—George A. Suchfield

*Attorney, Agent, or Firm*—A. J. McKillop; G. W. Hager; C. A. Malone

[57] ABSTRACT

A conduction assisted steam flooding process is described where heavy oil is recovered from reservoirs with limited native injectivity and a high water saturated bottom zone. A horizontal well is placed above the water saturated zone. This well is perforated on its top side at selected intervals. An uninsulated tubing having a circumference smaller than the well is inserted therein to its furthest end thereby making a first and second conduit. Steam is injected into the second conduit and formation fluids are removed by the first conduit or tubing until steam communication is established between the two intervals. Once steam communication is established between the intervals, steam injection is ceased and a thermal packer is placed around the tubing so as to form two separated, spaced-apart, perforated intervals. Thereafter, steam is injected into the reservoir via one interval and hydrocarbonaceous fluids are removed at the other interval.

14 Claims, 1 Drawing Sheet

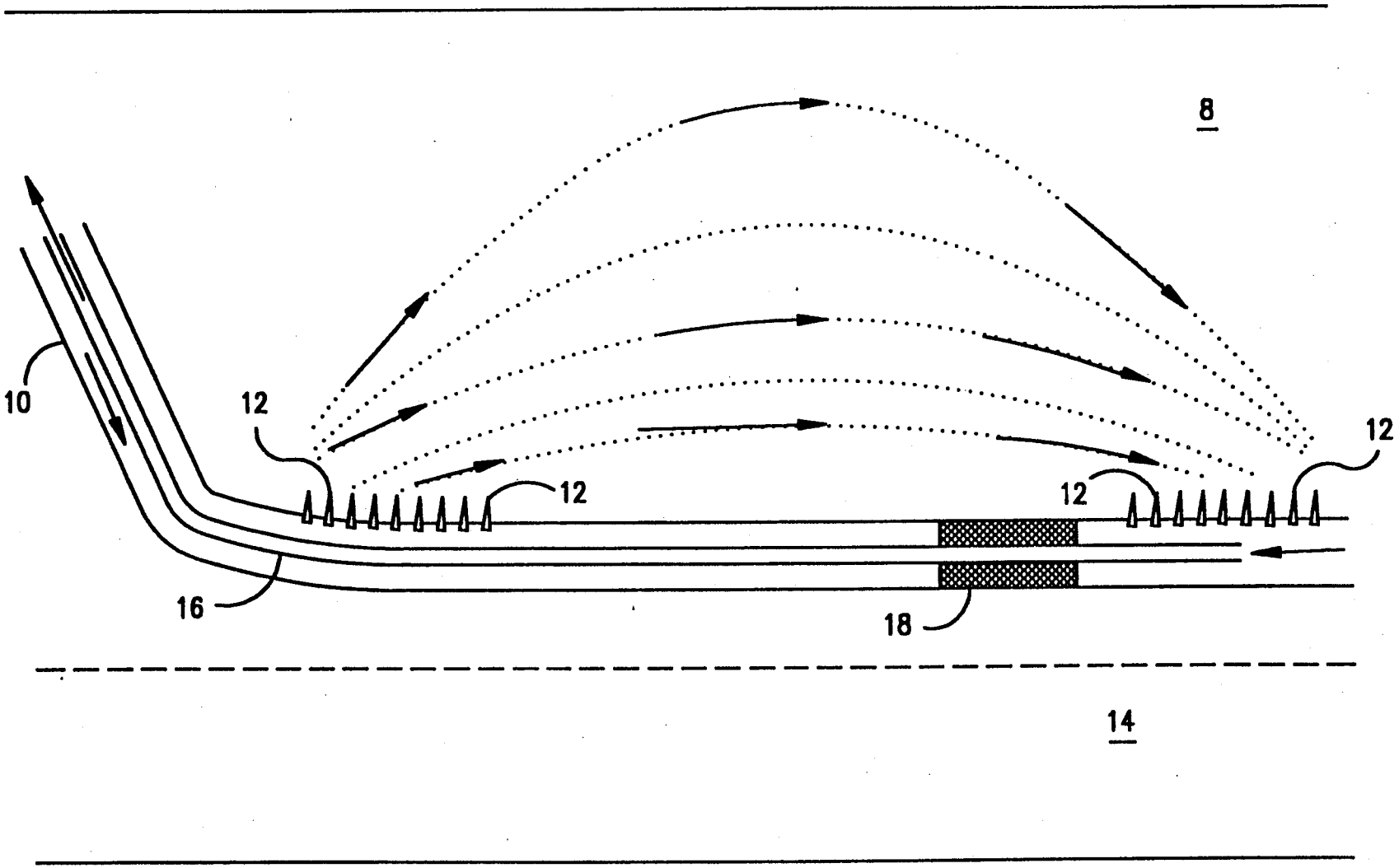
8
12
12
12
12
18
14
16
10

SINGLE HORIZONTAL WELL CONDUCTION ASSISTED STEAM DRIVE PROCESS FOR REMOVING VISCOUS HYDROCARBONACEOUS FLUIDS

FIELD OF THE INVENTION

This invention is directed to the removal of viscous hydrocarbonaceous fluids from a reservoir or formation. These fluids are removed from the reservoir by using a horizontal well in combination with conduction assisted steam flooding in a reservoir having limited native injectivity and a high water-saturated bottom zone.

BACKGROUND OF THE INVENTION

In many areas of the world, there are large deposits of viscous petroleum. Examples of viscous petroleum deposits include the Athabasca and Peace River regions in Canada, the Jobo region in Venezuela and the Edna and Sisquoc regions in California. These deposits are generally called tar sand deposits due to the high viscosity of the hydrocarbon which they contain. These tar sands may extend for many miles and may occur in varying thickness of up to more than 300 feet. Although tar sands may lie at or near the earth's surface, generally they are located under an overburden which ranges in thickness from a few feet to several thousand feet. Tar sands located at these depths constitute one of the world's largest presently known petroleum deposits.

Tar sands contain a viscous hydrocarbon material, which is commonly referred to as bitumen, in an amount which ranges from about 5 to about 16 percent by weight. This bitumen is usually immobile at typical reservoir temperatures. For example, at reservoir temperatures of about 60° F., bitumen is immobile, having a viscosity frequently exceeding several thousand poises. At higher temperatures, such as temperatures exceeding 200° F., the bitumen becomes mobile with a viscosity of less than 345 centipoises.

In situ heating is among the most promising methods for recovering bitumen from tar sands because there is no need to move the deposit and thermal energy can substantially reduce the bitumen's viscosity. Thermal energy may be introduced to tar sands in a variety of forms. For example, hot water, in situ combustion, and steam have been suggested to heat tar sands. Although each of these thermal energy agents may be used under certain conditions, steam is generally the most economical and efficient. It is clearly the most widely employed thermal energy agent.

Thermal stimulation processes appear promising as one approach for introducing these thermal agents into a formation to facilitate flow and production of bitumen therefrom. In a typical steam stimulation process, steam is injected into a viscous hydrocarbon deposit by means of a well for a period of time after which the steam-saturated formation is allowed to soak for an additional interval prior to placing the well on production.

To accelerate the input of heat into the formations, it has been proposed to drill horizontally deviated wells or to drill lateral holes outwardly from a main borehole or tunnel. Examples of various thermal systems using horizontal wells are described in U.S. Pat. No. 1,634,236, Ranney; U.S. Pat. No. 1,816,260, Lee; U.S. Pat. No. 2,365,591, Ranney; U.S. Pat. No. 3,024,013, Rogers et al.; U.S. Pat. No. 3,338,306, Cook; U.S. Pat. No. 3,960,213, Striegler et al.; U.S. Pat. No. 3,986,557, Striegler et al.; and Canadian Pat. No. 481,151, Ranney. However, processes which use horizontal wells to recover bitumen from tar sand deposits are subject to several drawbacks.

One problem encountered with use of horizontal wells to recover bitumen is the difficulty of passing a heated fluid through the horizontal well. During well completion bitumen will sometimes drain into the well completion assembly. This bitumen may block fluid flow through substantial portions of the horizontal well and thereby decrease heating efficiency.

Another problem which is encountered when using horizontal wells is that often the area stimulated is insufficient to make it economical to recover hydrocarbonaceous fluids from the reservoir or formation. Additionally, when horizontal wells are utilized in a water saturated bottom water zone, water coning often causes too much water to be produced with the hydrocarbonaceous fluids. Water coning is the phenomenum where water is drawn upwardly from a water-bearing portion of a formation into the oil-bearing portion about the well. Water coning causes free water to be produced in the well which results in a much higher water-to-oil ratio than would be the case without water coning. This higher water-to-oil ratio is undesirable and results in increased operating costs.

Therefore, what is needed is a method to thermally stimulate viscous hydrocarbonaceous fluids in a formation or reservoir which has limited native injectivity where a high water-saturated bottom zone is encountered.

SUMMARY OF THE INVENTION

This invention is directed to a method for removing viscous hydrocarbonacous fluids from a reservoir having limited native injectivity and which further contains a high water-saturated bottom water zone. In the practice of this invention, a cased horizontal well is directed into the reservoir above the water-saturated bottom water zone for a distance determined to be the most effective and efficient for the recovery of hydrocarbonaceous fluids from the reservoir. Afterwards, the well's casing is perforated on its top side at two spaced-apart intervals within the determined distance so as to make a first and second perforated interval to enable fluid communication between the reservoir and the well. Thereafter, an uninsulated tubing having a circumference smaller than the well is inserted into the well to its furtherest end. Being inserted in this manner, the tubing provides a first conduit and also causes a second conduit to be formed in annular space between said tubing and casing within the well which allows steam communication and removal of fluids from the reservoir.

Steam is next injected into the second conduit at a pressure slightly higher than the reservoir pressure. Steam flows from the well to the surface by the first conduit for a time sufficient to mobilize said viscous fluids near the horizontal well. Subsequently, steam injection pressure is reduced and hydrocarbonaceous fluids of reduced viscosity are produced to the surface by the first conduit. The steps of injecting steam and producing hydrocarbonaceous fluids from the reservoir is repeated until thermal communication is established in the reservoir between perforations in the two spaced apart intervals.

Once thermal communication has been established between said spaced-apart intervals, the tubing is removed from the well, fitted with a thermal packer, and inserted into the well again. This thermal packer is positioned on the tubing so as to form two isolated, spaced-apart, perforated intervals. Once in position, the packer causes a separation of the two spaced-apart intervals containing the perforation so as to enable one interval to serve as an injector conduit while the other interval serves as a producer conduit. Steam injection into the reservoir is reinstituted into the injector conduit for one interval while hydrocarbonaceous fluids of reduced viscosity are removed by a producer conduit at another interval. Since the horizontal well has been placed above the water-saturated bottom zone and the perforations are contained on the top side of the horizontal wellbore, production of water via water coning is minimized.

It is therefore an object of this invention to use conduction assisted steam flooding in a heavy oil reservoir with limited native injectivity which further contains a high water-saturated bottom zone so as to efficiently remove hydrocarbonaceous fluids from the reservoir.

It is another object of this invention to decrease production costs by substantially reducing the amount of water produced with hydrocarbonaceous fluids from the reservoir.

It is yet another object of this invention to use a conduction assisted steam drive process in combination with a horizontal well in order to remove substantially greater volumes of hydrocarbonaceous fluids from the reservoir than heretofore possible.

It is still another object of this invention to provide for a method to overcome a vertical permeability barrier in situations where such barrier is substantially extensive so as to be detrimental to other gravity-dominated horizontal well recovery processes.

It is still yet another object of this invention to provide for a method for removing hydrocarbonaceous fluids via a horizontal well which will avoid vertical profile deviations or changes in the horizontal section of a reservoir.

It is an even yet still further object of this invention to provide for a thermal recovery method via a horizontal wellbore which provides for excellent vertical sweep efficiency.

It is a still even yet further object of this invention to utilize steam override in a beneficial manner so as to enhance the recovery of hydrocarbonaceous fluids from the reservoir.

BRIEF DESCRIPTION OF THE DRAWING

The drawing is a schematic representation of the horizontal wellbore containing two perforated spaced-apart intervals and positioned over a water bottom zone in a reservoir.

BRIEF DESCRIPTION OF THE PREFERRED EMBODIMENTS

In the practice of this invention, referring to the drawing, horizontal well 10 is directed through limited native injectivity reservoir 8. The well is subsequently cased. Well 10 proceeds horizontally through formation 8 for a distance of about 600 feet. It is placed about 5 feet above high water-saturated zone or bottom water zone 14. Horizontal well 10 is about 7" in diameter and is cemented in a manner so as to be suitable for thermal operation at temperatures between about 450° to about 560° F. operating temperatures. Thereafter, horizontal well 10 is perforated at two separate spaced-apart locations. Each of the spaced-apart locations are at least 150 feet long and are perforated with 4 shots per foot so as to form perforations 12. In this manner two separate spaced apart perforated intervals are made in wellbore 10 so as to be in fluid communication with formation 8.

Perforations which are at the top of cased horizontal wellbore 10 can be made by any type of perforating gun. It is preferred to use those perforating guns such as a jet gun that can provide the roundest and most burr-free perforations. Any number of mechanical or magnetic-type decentralized perforating guns can be utilized for perforating along the top of the horizontal casing. A magnetic-type perforating gun uses magnets to orient the gun at the top of the casing. One type of casing gun is disclosed in U.S. Pat. No. 4,153,118. This patent is hereby incorporated by reference. However, as will be obvious to one skilled in the art, other types of perforating guns can be used as long as they are suitably capable of being oriented as required. The distance between the two perforated sections is at least about 300 feet. Another reason for perforating the well on its top side is to minimize water influx from bottom water zone 14, and to also take advantage of steam override.

After perforating the casing to the extent above-mentioned, a $2\frac{7}{8}$" uninsulated liner or tubing 16 is run through well 10 to its far end. Since the circumference of the liner is smaller than the diameter of the wellbore, the tubing thus provides a first conduit and also causes a second conduit to be formed in an annular space existing between the outside of said tubing and the well casing. Thus, two separate conduits exist for injecting steam into a formation and also for removing steam from the formation as well as any produced hydrocarbonaceous fluids.

Having positioned uninsulated liner or tubing 16 in the manner desired in the horizontal wellbore 10, steam injection is commenced into the annular space formed between the outside of the tubing 16 and well casing 10, hereinafter identified as the second conduit. Steam injection is continued at the rate of 100 barrels per day cold water equivalent (CWE) into the second conduit and it flows back through wellbore 10 via the first conduit formed in liner or tubing 16. Steam injection is conducted at a pressure slightly higher than the reservoir pressure for about 15 days. Steam injection pressure can be controlled at the surface by adjusting chokes positioned in the first conduit. After 15 days, steam injection pressure is reduced. Reduction in steam injection pressure is obtained by reducing the steam injection rate to about 50 barrels per day CWE. Steam which has been circulated through wellbore 10 and injected into formation 8 via perforations 12 contained in wellbore 10 heats up a radial volume around said wellbore so as to cause hydrocarbonaceous fluids in that volume to become reduced in viscosity. Hydrocarbonaceous fluids of reduced viscosity are produced to the surface along with any water or steam until no hydrocarbonaceous fluids are observed in the production stream. Production to the surface in this manner is continued for about ten days. In order to establish thermal and fluid communication between perforations contained on the near and far ends of wellbore 10, the steam injection and fluid production steps are repeated.

At the end of the steam injection and production phase, tubing 16 is pulled from wellbore 10. A thermal packer 18 is positioned on tubing 16. Subsequently, tubing 16 containing thermal packer 18 is reinserted into wellbore 10 in a manner so as to position packer 18 adjacent to the area containing perforations at the furtherest point of well 10. Thus, the packer is positioned so as to form two separated, spaced-apart, perforated intervals within well 10. Fluid communication between the two intervals in wellbore 10 is precluded since the annular space between liner 16 and the well casing is blocked. While one spaced-apart interval serves as an injector conduit, the other perforated interval serves as a producer conduit for fluid communication with reservoir 8.

Having separated wellbore 10 into two separate conduits for fluid communication with formation 8, steam injection is commenced. Steam is directed down the annular space formed with the outside of tubing 16 and the well casing. Perforations contained in the well casing closest to its vertical portion (near-end) allow steam to enter formation 8 where it contacts hydrocarbonaceous fluids. Steam pressure is such that it allows the steam to flow into formation 8 and eventually contact perforations contained in the furtherest end of wellbore 10. When contact is made with the steam and perforations in the furtherest end of wellbore 10, hydrocarbonaceous fluids of reduced viscosity, water and steam are directed up tubing 16 to the surface.

Production pressure is controlled at the surface by opening or closing chokes (not shown) to maintain a continuous two-phase, steam vapor and oil or condensed water production stream. Controlling the pressure in this manner also keeps the bottom hole pressure in the area of the liner's furthest end at or near the bottom water pressure. By doing these steps, a single horizontal well steam flooding process is initiated because near-end and far-end perforations thermally communicate with each other. Since the production bottom hole pressure is kept at or near the bottom water pressure, water coning is minimized. Because steam, due to gravity, rises to the top of formation 8, a substantially good vertical sweep efficiency is obtained. Butler et al. in U.S. Pat. No. 4,116,275 which issued Jul. 26, 1978 discloses concentric tubing conduits in a horizontal wellbore. This patent is hereby incorporated by reference herein. Use of a packer in a vertical well is disclosed by Gill in U.S. Pat. No. 3,547,193 which issued Dec. 15, 1970. This patent is also incorporated by reference herein.

Obviously, many other variations and modifications of this invention as previously set forth may be made without departing from the spirit and scope of this invention, as those skilled in the art readily understand. Such variations and modifications are considered part of this invention and within the purview and scope of the appended claims.

What is claimed is:

1. A horizontal well steam flooding oil recovery process for viscous hydrocarbonaceous fluid containing reservoirs having limited native injectivity and a water-saturated bottom water zone comprising:

a) directing a cased horizontal well into said reservoir above the bottom water zone for a distance determined to be the most effective and efficient for the recovery of hydrocarbonaceous fluids from the reservoir;

b) perforating said well on its top side at two spaced apart intervals within the determined distance so as to make a first and second perforated interval for fluid communication with the well;

c) inserting within said well to its farthest end an uninsulated tubing having a circumference smaller than the well where the tubing provides for a first conduit and also causes a second conduit to be formed in annular space between said tubing and casing within the well thereby allowing for steam communication and removal of fluids from said reservoir;

d) injecting steam into the second conduit at a pressure higher than the reservoir pressure and flowing steam from the well via the first conduit for a time sufficient to mobilize said viscous fluids near said wellbore;

e) reducing steam injection pressure and producing hydrocarbonaceous fluids of reduced viscosity, steam, and water to the surface by the first conduit;

f) repeating steps d) and e) until thermal communication is established between perforations in the two spaced apart intervals;

g) removing the tubing from said well and fitting the tubing with a thermal packer so as to allow the tubing and packer to be placed into the horizontal well;

h) inserting the tubing and packer into said well so as to position the packer in a manner sufficent to form two isolated, spaced apart, perforated intervals thereby causing one spaced apart interval with perforations therein to serve as an injector conduit while the other perforated interval serves as a producer conduit; and i) injecting steam into the reservoir via the injector conduit while removing hydrocarbonaceous fluids, steam, and water by the producer conduit.

2. The method as recited in claim 1 where in step i) hydrocarbonaceous fluids, steam, and water are continuously removed from the reservoir.

3. The method as recited in claim 1 where the production bottom hole pressure is kept at or near the bottom water pressure thereby minimizing water coning.

4. The method as recited in claim 1 where the horizontal well is completed low in a reservoir above bottom water contained in said reservoir.

5. The method as recited in claim 1 where the horizontal well is at least 600 feet long.

6. The method as recited in claim 1 where the horizontal well is at least 600 feet long and is positioned about 5 feet above a water-saturated zone in said reservoir.

7. The method as recited in claim 1 where in step b) each spaced apart perforated interval is at least about 150 feet long and is perforated at 4 shots per foot.

8. The method as recited in claim 1 where a distance of about 300 feet exists between said spaced apart perforated intervals.

9. The method as recited in claim 1 where in step d) steam is injected into the second conduit at a rate of about 100 barrels per day (CWE) for about 15 days.

10. The method as recited in claim 1 where in step d) steam is injected into the second conduit at a rate of about 100 barrels per day (CWE) for about 15 days and thereafter hydrocarbonaceous fluids are produced from the reservoir for about 10 days.

11. The method as recited in claim 1 where steps d) and e) are repeated for about 50 days.

12. A horizontal well steam flooding oil recovery process for viscous hydrocarbonaceous fluid containing reservoirs having limited native injectivity and a water saturated bottom water zone comprising:

a) directing a cased horizontal well into said reservoir for a distance of about 600 feet which well is positioned about five feet above a water-saturated zone in said reservoir;

b) perforating said well on its top side at two intervals of about 150 feet each which are spaced about 300 feet apart where each interval is perforated with four shots per foot so as to be in fluid communication with said reservoir;

c) inserting within said well to its farthest end an uninsulated tubing having a circumference smaller than the well where the tubing provides for a first conduit and also causes a second conduit to be formed in annular space between said tubing and casing within the well thereby allowing for steam communication and removal of fluids from said reservoir;

d) injecting about 100 bbl/day CWE of steam into the second conduit at a pressure higher than the reservoir pressure and flowing steam from the well via the first conduit for about 15 days to mobilize said viscous fluids;

e) reducing steam injection pressure and producing hydrocarbonaceous fluids of reduced viscosity, steam, and water to the surface by the first conduit for about ten days;

f) repeating steps d) and e) for about 50 days until thermal communication is established between perforations in the two spaced apart intervals;

g) removing the tubing from said well and fitting the tubing with a thermal packer so as to allow the tubing and packer to be placed into the horizontal well about 100 feet from perforations contained in the second interval farthest from an angle formed by a vertical and interconnected horizontal portion of the horizontal well;

h) inserting the tubing and packer into said well so as to position the packer in a manner sufficent to form two isolated, spaced apart, perforated intervals thereby causing one spaced apart interval with perforations therein to serve as an injector conduit while the other perforated interval serves as a producer conduit; and i) injecting steam into the reservoir via the injector conduit while removing hydrocarbonaceous fluids, steam, and water by the producer conduit.

13. The method as recited in claim 12 where water production is substantially reduced as the production bottom hole pressure is kept at or near the bottom water pressure thereby minimizing water coning during the production of hydrocarbonaceous fluids from the reservoir.

14. The method as recited in claim 12 where in step i) hydrocarbonaceous fluids, steam, and water are continuously removed from the reservoir.

* * * * *